US008834220B2

(12) United States Patent
Haller et al.

(10) Patent No.: US 8,834,220 B2
(45) Date of Patent: Sep. 16, 2014

(54) INFLATABLE STAND-UP PADDLE BOARD

(75) Inventors: Clayton F. Haller, Concord, CA (US); Charles P. Hall, Bainbridge, WA (US)

(73) Assignee: Advanced Elements, Inc., Benicia, CA (US)

( * ) Notice: Subject to any disclaimer, the term of this patent is extended or adjusted under 35 U.S.C. 154(b) by 0 days.

(21) Appl. No.: 13/618,319

(22) Filed: Sep. 14, 2012

(65) Prior Publication Data

US 2014/0080369 A1 Mar. 20, 2014

(51) Int. Cl.
*B63B 35/79* (2006.01)
*B63B 3/38* (2006.01)

(52) U.S. Cl.
USPC ..... 441/74; 114/140

(58) Field of Classification Search
CPC ..... B63B 3/38; B63B 41/00; B63B 35/79
USPC ..... 441/74; 114/140, 39.15
See application file for complete search history.

(56) References Cited

U.S. PATENT DOCUMENTS

| | | | | | |
|---|---|---|---|---|---|
| 1,881,231 | A | * | 10/1932 | Jackson | 293/143 |
| 3,374,495 | A | * | 3/1968 | Joyce | 441/74 |
| 4,766,830 | A | * | 8/1988 | Kunz | 114/39.26 |
| 4,792,316 | A | * | 12/1988 | Skedeleski et al. | 441/74 |
| 4,955,314 | A | * | 9/1990 | Skedeleski et al. | 114/219 |
| 6,066,016 | A | | 5/2000 | Yonover | |
| 7,316,597 | B2 | * | 1/2008 | Skedeleski | 441/65 |
| 2009/0049757 | A1 | * | 2/2009 | Potter | 52/2.23 |

* cited by examiner

*Primary Examiner* — Stephen Avila
*Assistant Examiner* — Andrew Polay
(74) *Attorney, Agent, or Firm* — Lowe Graham Jones PLLC

(57) ABSTRACT

A stand-up paddle board and nosecap are disclosed. The stand-up paddle board is made using drop-stitching and in inflatable. The nosecap is made using injection molding techniques and is relatively rigid. The nosecap is attached to the stand-up paddle board and provides the board with a displacement hull to more easily move through the water.

21 Claims, 7 Drawing Sheets

100
124
118
114
120
124
122
116
152
150
170
154
156
160

100
124
118
114
112
120
124
122
150

200
224
210
214
220
212
224
230
216
252
266
264
256
250

200
218
210
214
220
212
224
216
266
264
256
250

INFLATABLE STAND-UP PADDLE BOARD

FIELD OF THE DISCLOSURE

This disclosure relates generally to a drop-stitched, inflatable stand-up paddle board having a semi-rigid nosecap providing a displacement hull.

BACKGROUND OF THE DISCLOSURE

The stand-up paddle boards referenced herein are generally small, human-powered boats that are traditionally rowed over a body of water while the rider stands upon the board. Many inflatable boards, including surfboards and stand-up paddle boards made with drop-stitch construction are generally flat because the flat structure is more easily constructed than a contoured surface. However, a flat board moves less efficiently through the water. Also, many paddle boards do not have a displacement hull. Drop-stitch construction is a process for forming inflatable structures that are very durable and rigid when inflated. A typical drop-stitch construction involves joining two generally parallel, usually flat sheets of material with hundreds or thousands of thin threads between the sheets. Sidewalls can be attached to seal the interior of the structure, which can then be inflated. Conventional inflatable paddle boards and surfboards made from drop-stitch construction are flat or have a slight unidirectional contour.

A flat construction for inflatable paddle boards, where the top and bottom walls of the drop-stitch construction are generally parallel with each other and with the water surface, is relatively inexpensive to manufacture and are easily portable. However, these boards sacrifice movement efficiency. There is a need for a board that is easily constructed, easily portable, and that has excellent hydrodynamic qualities.

An example of a boat made using drop stitch techniques is shown in U.S. Pat. No. 7,861,662 to Rista. Rista is directed to a boat made of upper and lower fabric layers and also a core section made up in an array of threads extending throughout the drop stitch structure, and sidewalls enclosing the drop stitch structure. However, the boats disclosed by Rista do not have displacement hulls and therefore are less efficient than other watercraft having a displacement hull.

SUMMARY OF THE DISCLOSURE

At least one embodiment of the present disclosure is directed to a stand-up paddle board including an inflatable board and a semi-rigid, non-inflatable nosecap. The board includes a top panel and a bottom panel secured together by drop-stitching, and side panels extending between the top and bottom panels. The top panel, bottom panel, and sidewalls form an interior volume of the board and are sealed over the drop stitch construction. The nosecap is semi-rigid and non-inflatable and has a contoured front surface that contacts the water as the board moves through the water and a contact surface configured to be secured to the bottom panel of the board. The nosecap is sufficiently rigid to maintain its shape when the board is uninflated.

In further embodiments the present disclosure is directed to a nosecap to be secured to a stand-up paddle board. The board comprises a drop-stitched inflatable structure. The board can be flat or have some curvature. The nosecap has a top portion, sidewalls coupled to the top portion, and a bottom portion coupled to the sidewalls. The bottom portion forms a displacement surface configured to displace water laterally outwardly as the board is propelled through the water. The nosecap is non-inflatable and sufficiently rigid to maintain its shape when the board is uninflated.

In still further embodiments the present disclosure is directed to an inflatable stand-up paddle board including a board and a nosecap. The board has a top panel, a bottom panel, and drop stitching formed between the top panel and the bottom panel. The top panel and bottom panel are substantially parallel and substantially flat. The board also has sidewalls coupled to the top and bottom panels and sealing an interior volume of the board defined by the top panel, bottom panel, and sidewalls. The nosecap has a top portion, sidewalls coupled to the top portion, and a bottom portion coupled to the sidewalls. The top portion, sidewalls, and bottom portion define a recess configured to receive the nose of the board. The bottom portion of the nosecap is not flat.

BRIEF DESCRIPTION OF THE DRAWINGS

Preferred and alternative embodiments of the present disclosure are described in detail below with reference to the following drawings.

DETAILED DESCRIPTION OF THE PREFERRED EMBODIMENTS

The present disclosure relates generally to inflatable stand-up paddle boards and non-inflatable, semi-rigid nosecaps. The nosecaps are uninflatable and provide a desired contoured shape to the nose of the board, such as a displacement hull which improves maneuverability and efficiency when moving through the water. The boards can be uninflated and folded, rolled, or otherwise stored and transported easily, while the nosecaps retain their shape even when the board is uninflated. The size of the nosecaps relative to the board is such that the board is easily portable even while the nosecap maintains its shape in the uninflated state. The board can be made using drop-stitching techniques and, in some embodiments, the board can have a flat shape where the top and bottom panels of the board are generally parallel. The nosecap can provide the desired shape. Accordingly, the boards of the present disclosure can be made efficiently and inexpensively without sacrificing hydrodynamic qualities. Embodiments of the present disclosure can be applied to other watercraft, such as surfboards, rescue rafts, and others. For purposes of brevity and conciseness, however, this disclosure primarily addresses inflatable stand-up paddle boards.

Figures 1A, 1B:
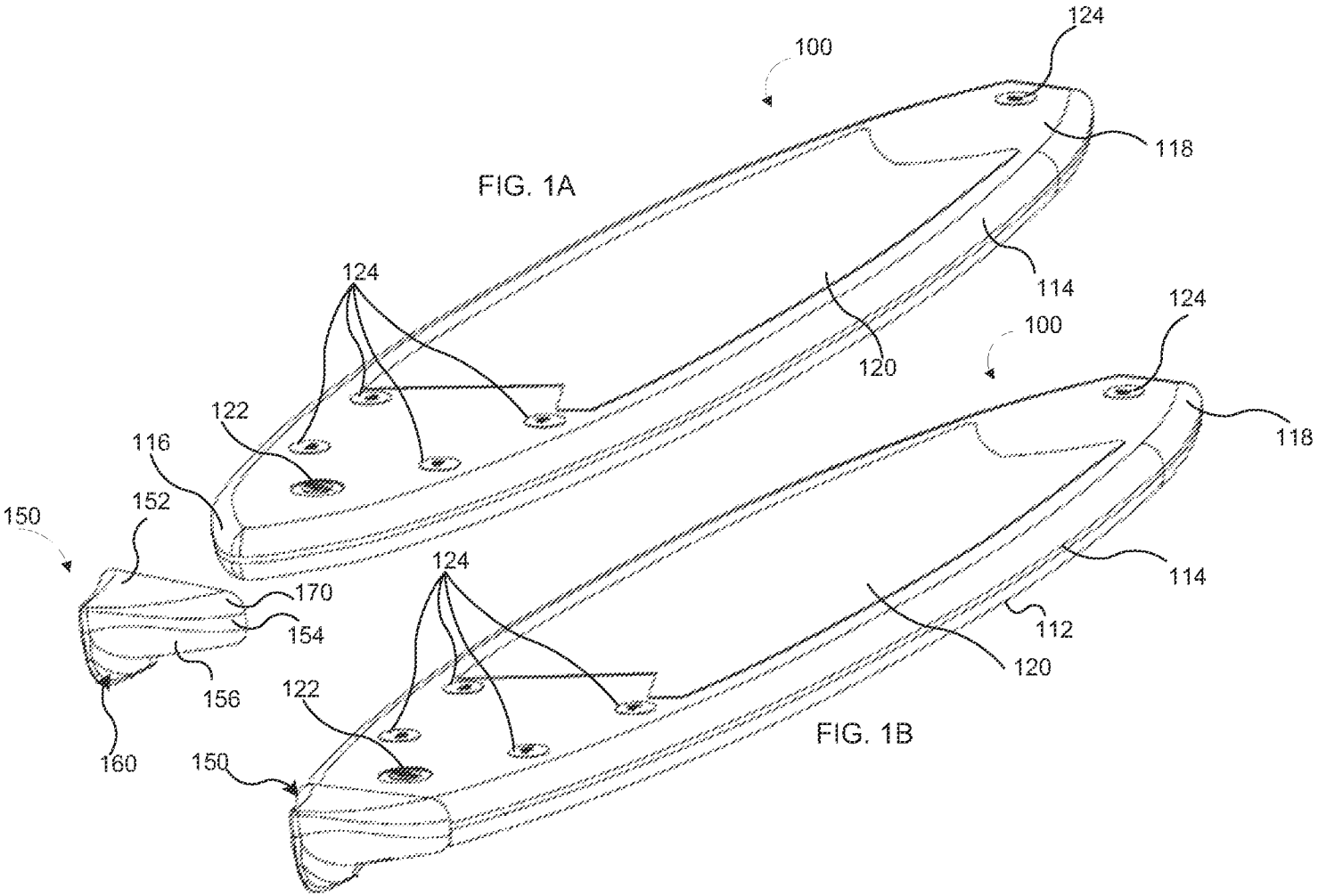
FIG. 1A is an isometric view of a stand-up paddle board and a nosecap according to embodiments of the present disclosure.
FIG. 1B is an isometric view of the stand-up paddle board of FIG. 1B with the nosecap installed onto the stand-up paddle board according to embodiments of the present disclosure.

FIG. 1A is an isometric view of a stand-up paddle board 100 and a nosecap 150 according to embodiments of the present disclosure. The board 100 can be constructed with drop-stitch techniques that are known in the art. The board 100 includes a top panel 110 and a bottom panel 112 that are generally parallel and spaced apart by a certain distance that defines the thickness of the board 100. Between the top panel 110 and the bottom panel 112 are many small fibers that secure the panels together and provide exceptional rigidity. The board 100 also includes side walls 114 joined to the top and bottom panels 110, 112 to seal the interior of the board 100. The interior volume of the board 100 can then be pressurized through an air valve 122. The top panel 110 and bottom panel 112 can be generally flat and parallel. The board 100 has a nose 116, a tail 118, a grip pad 120, and D-rings 124 to which equipment may be strapped. The board 100 can also include other features conventionally found on paddle boards and other watercraft, such as fins and a leash etc.

The nosecap 150, in some embodiments, is a plastic, injection-molded, integral member that is shaped to receive the nose 116 of the board 100 and to therefore be secured to the nose 116 of the board 100. The nosecap 150 can be a semi-rigid member that is not inflatable, but is attached to the board 100. The nosecap 150 therefore substantially maintains its shape even when the board 100 is uninflated and stored. The nosecap 150 is relatively small relative to the size of the board 100 so that when the board 100 is uninflated and folded, rolled, or otherwise stored the nosecap 150 is not excessively bulky. The nosecap 150 can be made of a plastic or other suitable material and can therefore have virtually any desired rigidity. In some embodiments the nosecap 150 is nearly perfectly rigid; in other embodiments, the nosecap 150 is sufficiently rigid to maintain its shape when the board 100 is stored, but is pliable enough to resiliently deflect under a load. The nosecap 150 can be made using techniques other than injection molding, and is generally a non-inflatable structure that is generally more rigid than the board 100.

The nosecap 150 has a top surface 152, side walls 154, a displacement surface 156, and a keel 160. The keel 160 extends generally vertically along a midline of the board 100 from the top surface 152 downwardly and rearwardly along the longitudinal axis of the board 100. The displacement surface 156 flanks the keel 160 and is below the sidewalls 154 of the nosecap 150. The nosecap 150 also includes upper rounds 170 that match the contour of the sidewalls 114 of the board 100. The nosecap 150, having a hydrodynamic shape can be used with a board 100 that does not necessarily have a hydrodynamic shape, but is more easily and less expensively constructed. For example, the board 100 can be flat and therefore inexpensive to make, but with the nosecap 150 the board 100 has a hydrodynamic shape. The nosecap 150 can provide virtually any suitable shape to the board 100, including a simple uni-directional rocker, or any other desired shape.

FIG. 1B is an isometric view of the stand-up paddle board of FIG. 1B with the nosecap installed onto the stand-up paddle board according to embodiments of the present disclosure. The nosecap 150 is open at the rear and receives the nose 116 of the board 100. The nosecap 150 can be secured to the board permanently, such as by adhesive or glue, or temporarily, such as with a press-fit, friction fit, or fasteners. The nose 116 of the board 100 can have a recess or jog shaped to receive the nosecap 150 to help align the nosecap 150 to the board 100 properly and to provide a sleek seam between the nosecap 150 and the board 100. The keel 160 and the displacement surface 156 give the board 100 a more hydrodynamic shape that allows the board 100 to better maneuver through water. A displacement hull is generally defined as one that relies on buoyancy of the vessel. In other words, the hull moves water outwardly as the vessel is propelled through the water. The displacement surface 156 is forward-facing and outward-facing. A vector normal to the displacement surface 156 has a forward component and an outward component. The board 100 and nosecap 150 configuration can be deflated and folded with the nosecap 150 remaining attached to the board 100. Or, in the case of a removable nosecap 150, the nosecap 150 can be removed and the board 100 can be deflated and folded for portability.

FIGS. 2A-2D are isometric, side, front, and rear views, respectively, of the nosecap of FIGS. 1A and 1B according to embodiments of the present disclosure. The top 152 of the nosecap 150 can have an upward sloping contour and a generally triangular shape in a top plan view. The nosecap 150 has an apex 162 at the highest point of the keel 160. The keel 160 also has a vertically extending region 168, a transition region 166, and a longitudinally extending region 164 that is generally parallel with the bottom surface of the board 100. The transition region 166 can be rounded and is between the vertically extending region 168 and the longitudinally extending region 164. The keel 160 has a keel sidewall 161. The displacement surface 156 extends between the sidewall 154 and the keel sidewall 161. The keel 160 also has a keel tail 176 that extends below the bottom panel 112 of the board 100 (shown to greatest advantage in FIGS. 2B and 2D). The transition between the top 170, sidewall 154, displacement region 156, keel sidewall 161 and the keel 160 itself can be smooth and continuous. In some embodiments, the transition between these portions can be discrete having ridges defining the borders between the components. In any case, the lower forward surface of the nosecap 150 provides the board 100 with the desired displacement hull.

Figure 2B:
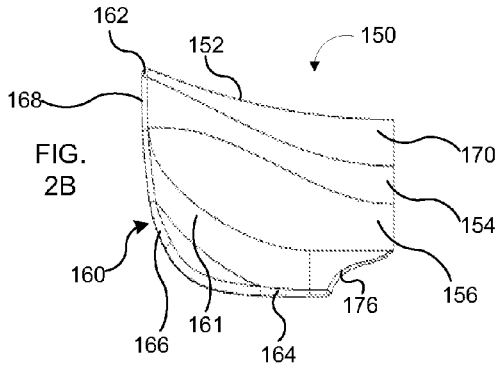
FIGS. 2A-2D are isometric, side, front, and rear views, respectively, of the nosecap of FIGS. 1A and 1B according to embodiments of the present disclosure.
Figure 2A:
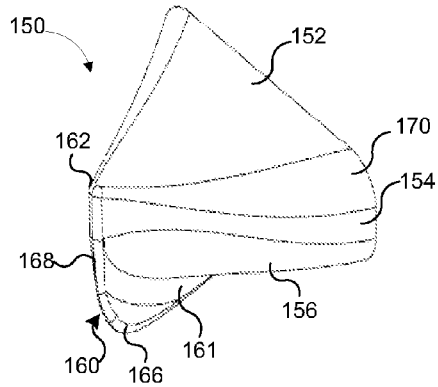
Figure 2C:
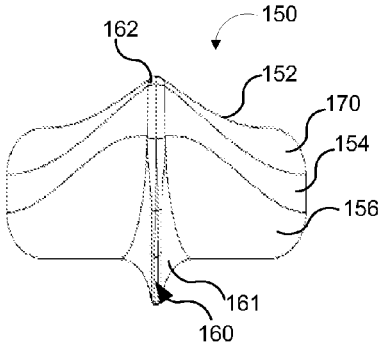
Figure 2D:
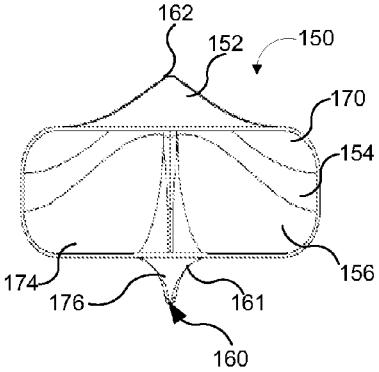

FIG. 2D illustrates the rear of the nosecap 150. The interior surface 174 of the nosecap 150 is the contact surface and is shaped to receive the nose 116 of the board (FIGS. 1A and 1B). The keel 160 extends downward below the bottom surface of the board. The dimensions of the keel can be varied according to the needs of a particular application. In some embodiments the interior surface 174 can be shaped precisely to receive the nose 116. In other embodiments the interior volume of the nosecap 150 is not shaped exactly according to the shape of the nose 116 and therefore some open space will exist between the nosecap 150 and the board 100 when the board 100 is in the nosecap 150. For example, the nosecap 150 can be made using injection molding and can have walls of uniform thickness. Since the internal shape of the nosecap 150 is different than that of the nose 116 of the board some open space will exist within the nosecap 150. Alternatively, if the walls are of non-uniform thickness, the nosecap 150 can be coupled to the nose 116 of the board 100 without open space between. The nosecap 150 can be sealed to the board 100 sufficiently to prevent moisture or debris from penetrating the interior space, if any.

Figure 3:
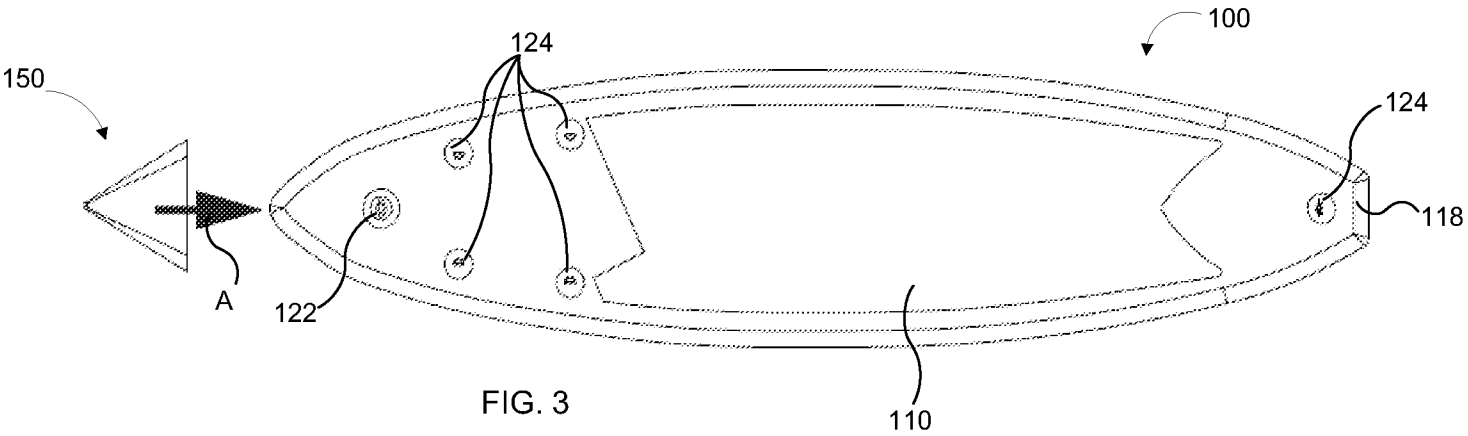
FIG. 3 is a top view showing an installation procedure for assembling the board and nosecap of the present disclosure.

FIG. 3 is a top view showing an installation procedure for assembling the board 100 and nosecap 150 of the present disclosure. The board 100 can be constructed and inflated and then the nosecap 150 can be inserted onto the board 100 as shown by the arrow A. The nosecap 150 can be prepared with an adhesive or glue or with other preparations (including perhaps temporary coupling means) before the board 100 is installed into the nosecap 150. The board 100 can be made of a polyvinyl chloride (PVC) material or another suitable material. The nosecap 150 can be made of a vinyl or vulcanized rubber or another suitable material. If glue or adhesives are to be used they will be chosen to complement the materials of the board 100 and the nosecap 150. The nosecap 150 can be approximately 18-20 inches in length as measured in a longitudinal direction relative to the board 100. In any case the nosecap 150 should be long enough to provide stability but not so long that the size of the board in its uninflated state is too large for convenient carrying and storage.

Figure 4A:
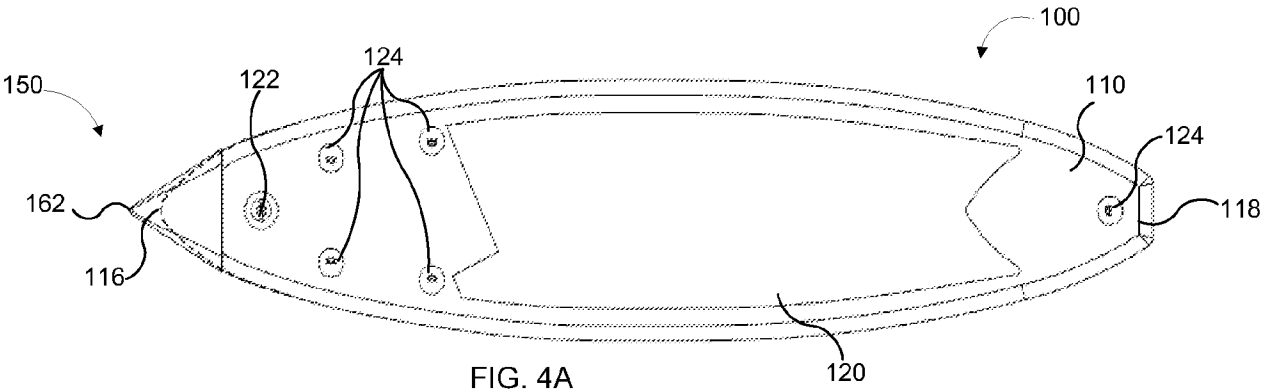
FIGS. 4A-4C are top, bottom, and side views, respectively, of a stand-up paddle board and nosecap according to embodiments of the present disclosure.
Figure 4B:
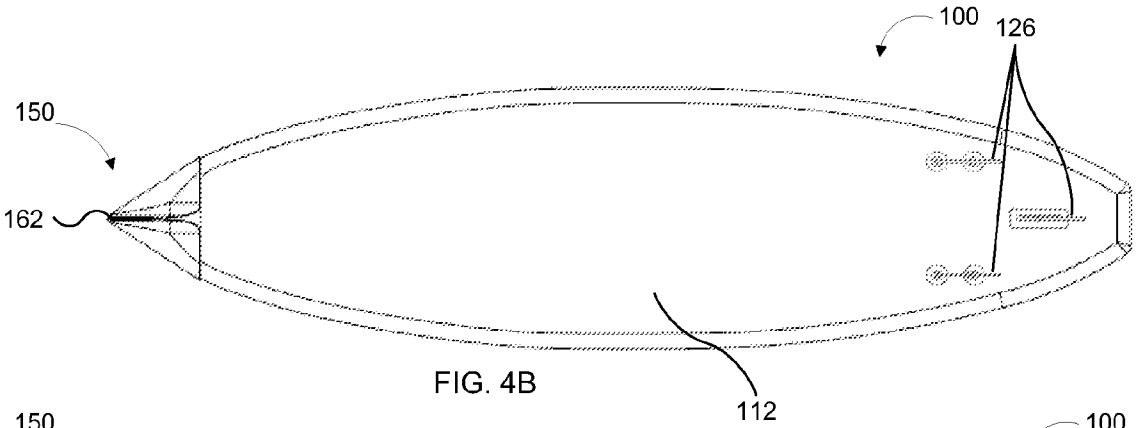
Figure 4C:
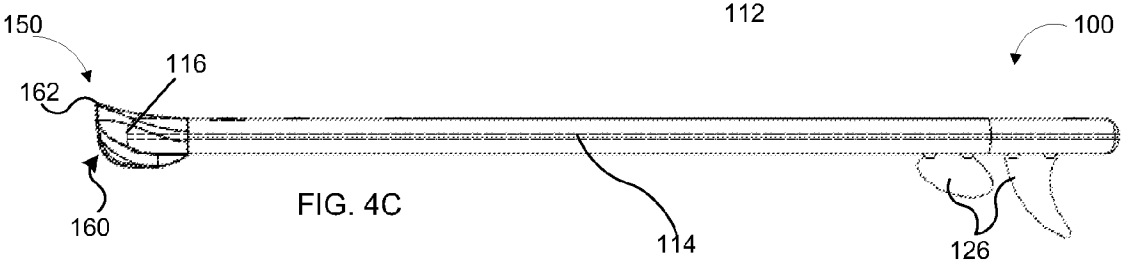

FIGS. 4A-4C are top, bottom, and side views, respectively, of a stand-up paddle board 100 and nosecap 150 according to embodiments of the present disclosure. The shape of the board 100 within the nosecap 150 is shown in phantom lines in FIGS. 4A and 4C. The apex 162 extends slightly beyond the nose 116 of the board 100. At the rearward most extent of the nosecap 150 the board 100 and the nosecap 150 are substantially tangential to provide a sleek, hydrodynamic shape to the board 100. The nosecap 150 can be triangular when viewed from above. In some embodiments the sides of the nosecap 150 can be concave or convex or otherwise contoured to complement the shape of the board 100. As shown in FIG. 4C, the keel tail 176 extends lower than the bottom surface 112 of the board 100. The fins 126 can also be seen.

Figures 5A, 5B:
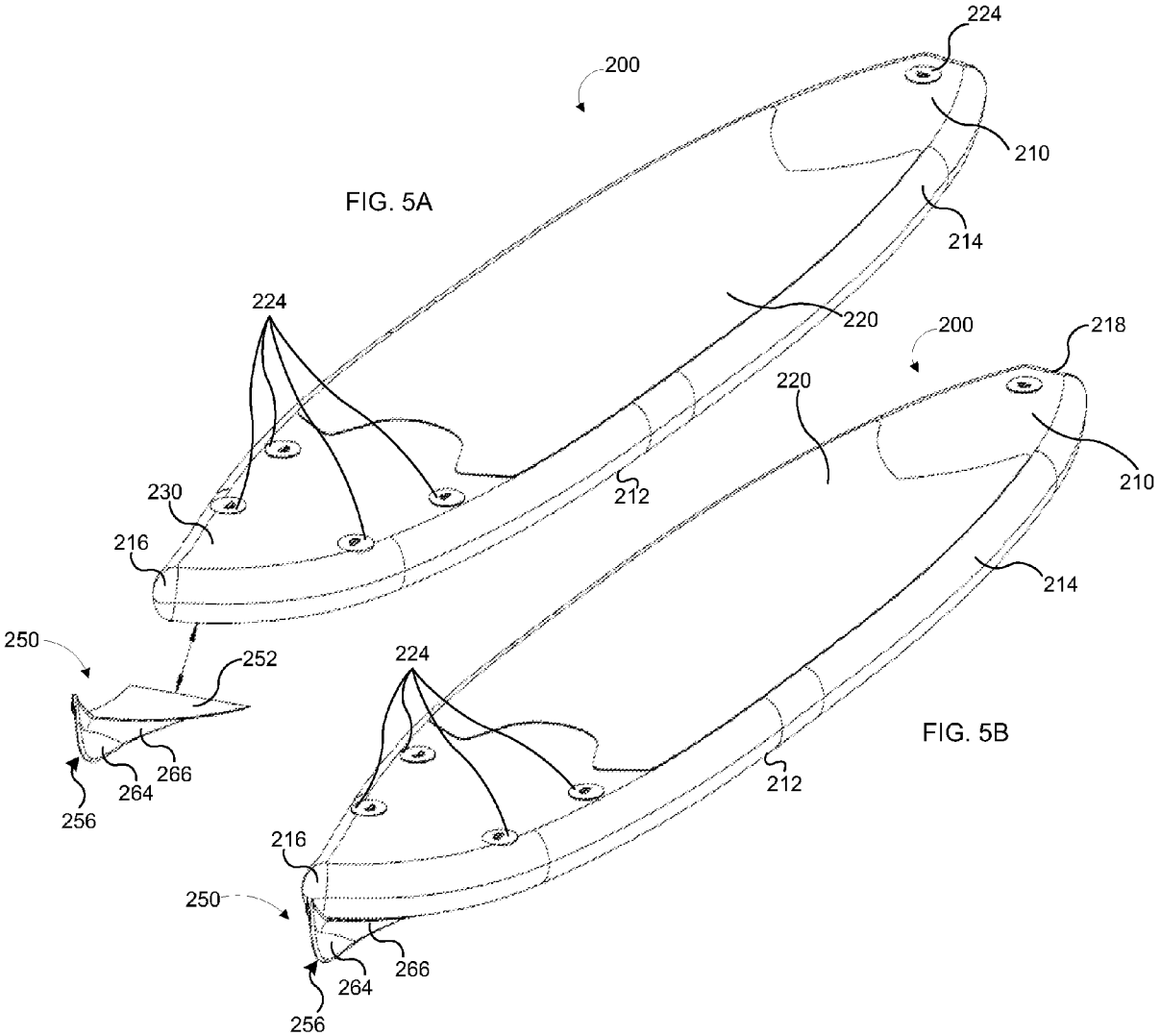
FIG. 5A is an isometric view of a stand-up paddle board and nosecap according to further embodiments of the present disclosure.
FIG. 5B is an isometric view of the stand-up paddle board and nosecap of FIG. 5A with the nosecap installed onto the nose of the stand-up paddle board according to embodiments of the present disclosure.
Figure 6A:
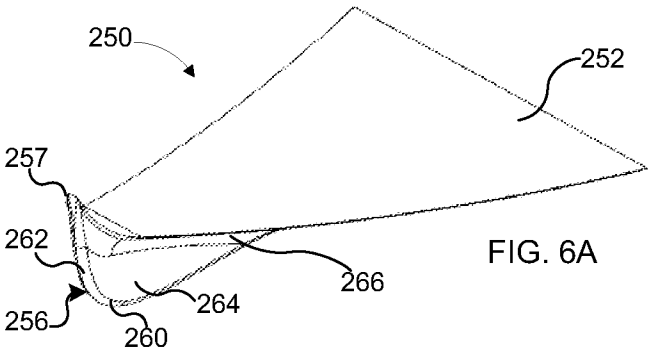
FIGS. 6A-6E are isometric, isometric, side, front, and rear views, respectively, of the nosecap of FIGS. 5A and 5B according to embodiments of the present disclosure.
Figure 6B:
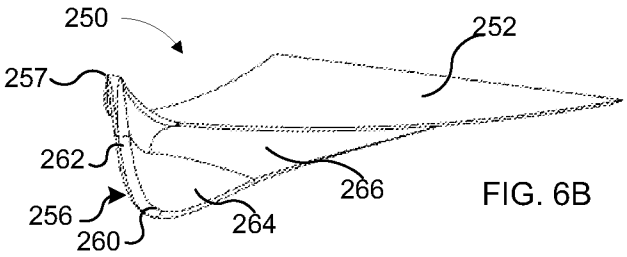
Figure 6C:
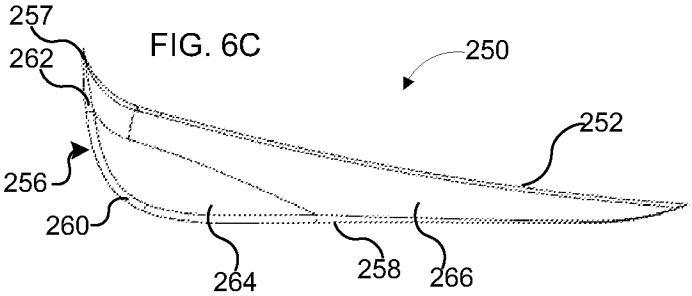
Figure 6D:
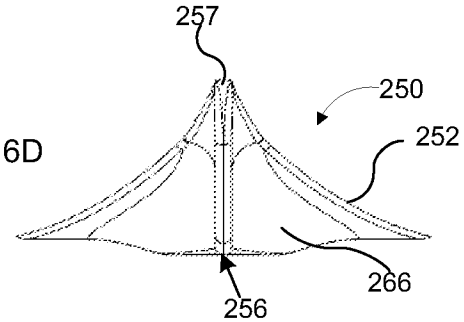
Figure 6E:
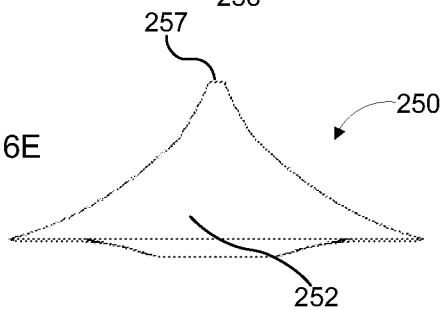

FIG. 5A is an isometric view of a stand-up paddle board 200 and nosecap 250, and FIG. 5B is an isometric view of board 200 and nosecap 250 installed onto the nose 216 of the board 200 according to embodiments of the present disclosure. The board 200 can be substantially similar to the board 100 shown previously with drop stitch construction and having a top panel 210, bottom panel 212, side panels 214, a nose 216, and a tail 218. The board 200 also includes D-rings 224, fins (not shown), an inflation valve (not shown), and other board features. The front region 230 of the board 200 can include a slight rocker or upward slope toward the nose 216 of the board 200. In other embodiments, the board 200 is shaped differently, including a flat shape or a longitudinal V-shape. In any case the nosecap 250 can conform to the shape of the board 200. The nosecap 250 can be coupled to the bottom, side, or top of the board, or any combination thereof, to alter the shape of the board for purposes other than improving the direct contact with the water, such as aerodynamics or storage provisions.

The nosecap 250 is a generally flat, sloped member having a contact region 252 configured to couple to the bottom surface of the board 200. The nosecap 250 includes a keel 256 extending downward and generally aligned with a longitudinal midpoint of the nosecap 250 and board 200. The contact region 252 is sloped upwardly to match the rocker of the board 200 and has a generally triangular shape when viewed from the top, also to match the board 200. The nosecap 250 is secured to the board 200 with an adhesive, glue, or another suitable attachment mechanism such as a fastener or press-fit and therefore leaves the top side of the board 200 uncovered. The nosecap 250 has a displacement surface 266 similar to the displacement surface of other embodiments elsewhere described herein with a forward and outward-facing surface that displaces water as the board 200 is propelled through the water.

FIGS. 6A-6D are isometric, isometric, side, front, and rear views, respectively, of the nosecap 250 of FIGS. 5A and 5B according to embodiments of the present disclosure. The nosecap 250 has a keel 256 having an apex 257, a vertically extending region 262, a transition region 260, and a longitudinally extending region 258. The keel 256 also includes keel sidewalls 264 that are substantially vertical and face predominantly outward. In the pictured embodiment the keel sidewalls 264 have no forward-facing component; however, in other embodiments, the keel sidewalls 264 face slightly forward and outward. The displacement surface 266 operates as described above by moving water outwardly as the board 200 is propelled through the water. The apex 257 can extend approximately to the vertical midpoint of the board 200. In other embodiments the apex 257 is higher or lower than the vertical midpoint. The surfaces of the nosecap 250 can be continuously curved from the keel to the outer extent of the nosecap 250. Alternatively the boundaries between regions, such as the keel sidewall 264 and the displacement surface 266 can be discontinuous. The nosecap 250 is thickest at the keel 260 and is progressively thinner toward the outer extents with the thinnest portion being at the extreme edge of the nosecap 250 to mate with the surface of the board 200 in a nearly tangential angle. These complementary curvatures provide a sleek shape to the board 200 and nosecap 250 combination.

Figure 7A:
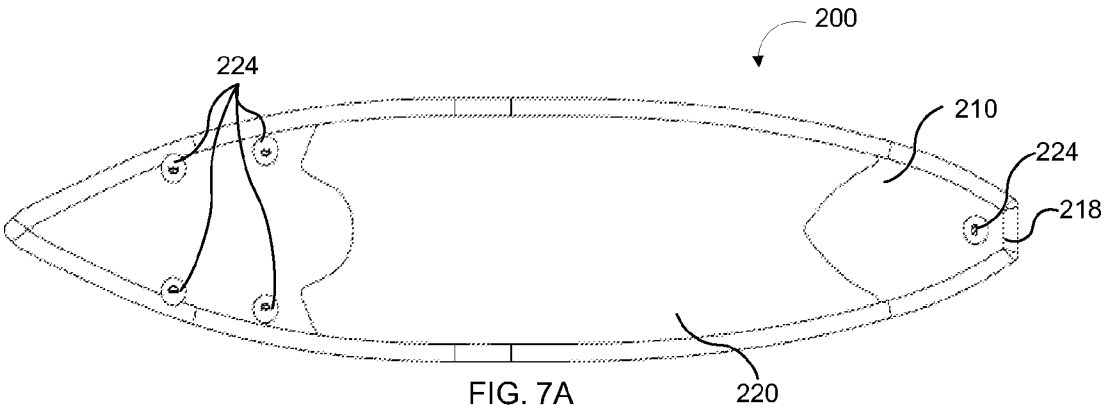
FIGS. 7A-7C are top, bottom, and side views of the stand-up paddle board and nosecap according to embodiments of the present disclosure.
Figure 7B:
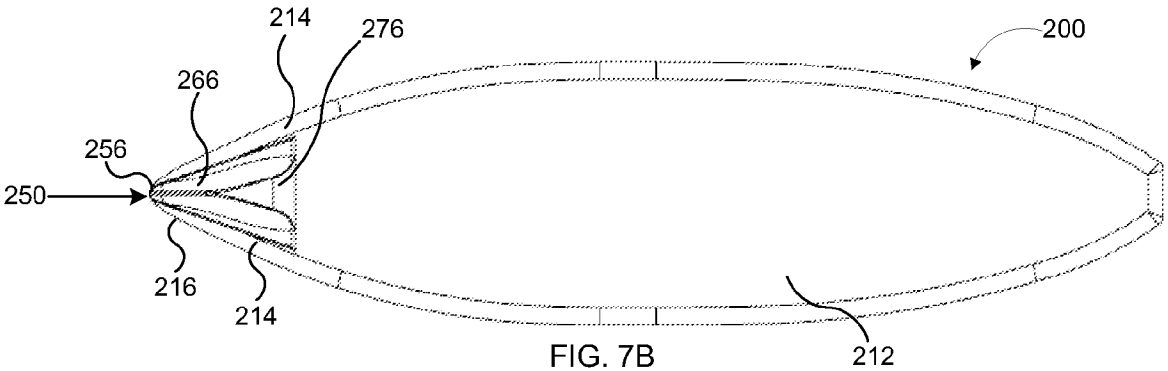
Figure 7C:
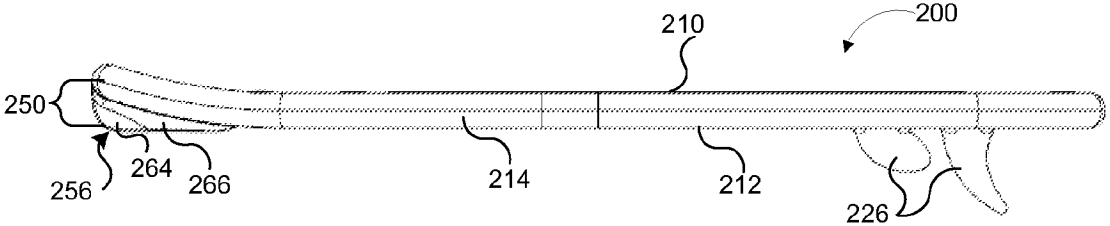

FIGS. 7A-7C are top, bottom, and side views of the stand-up paddle board 200 and nosecap 250 according to embodiments of the present disclosure. From FIG. 7A it can be seen that the nosecap 250 does not obscure the top surface of the board 200 because the nosecap 250 is not visible in a top plan view of the board 200. As shown in FIG. 7B, nearly the entire nosecap 250 is within the bottom panel 212. In at least some embodiments the nosecap 250 does not contact the sidewalls 214 except at the nose 216 of the board 200. The keel 256 also includes a keel tail 276 having a filleted rear section that provides stability to the keel 256. The keel tail 276 is wider toward the rear of the keel 256. FIG. 7C also illustrates how the keel 256 extends slightly lower than the bottom panel 212 of the board 200. In any of the embodiments disclosed herein the keel can extend to any suitable length relative to the bottom of the board. For example, the embodiment pictured in FIGS. 1-2D can include a keel that does not extend beyond the bottom panel of the board.

The nosecaps 150, 250 described herein can be used with virtually any suitable board shape. This permits a more inexpensive, more easily portable board (such as a flat board) to be used while still achieving superior hydrodynamics due to the shape of the nosecap. The nosecaps are formed separate from the board and installed thereon. The nosecaps are non-inflatable and have sufficient rigidity to maintain shape even when the board is uninflated and stored. The rigidity of the nosecaps also prevents damage to the board as the nose strikes objects in the normal course of use.

While the preferred embodiments of the disclosure have been illustrated and described, as noted above, many changes can be made without departing from the spirit and scope of the disclosure. For example, a nosecap can be constructed for use with another portion of the board, such as the rear or sides of the board. Also, aspects of this disclosure can also be used with vessels other than paddle boards, including surfboards, rafts and the like. The dimensions of the nosecap and board can vary according to the application for which the board and nosecap combination is intended. For example, a board that is designed to be more portable can have a smaller nosecap to permit the uninflated board to be more easily transported. In other embodiments multiple nosecaps can be used in different places on the board to provide a desired shape to the board. In still further embodiments the external hull shape provided by the nosecap is not strictly a displacement hull shape, but can provide other shapes to other portions of the board. Accordingly, the scope of the disclosure is not limited by the disclosure of the preferred embodiments. Instead, the disclosure should be determined entirely by reference to the claims that follow.

The embodiments of the disclosure in which an exclusive property or privilege is claimed are defined as follows:

1. A stand-up paddle board, comprising:

a board comprising a front end and a rear end, and a top panel and a bottom panel secured together by drop-stitching, and side panels extending between the top and bottom panels and sealing the drop stitch construction, wherein the board is inflatable;

a semi-rigid, non-inflatable nosecap having a contoured front surface and a contact surface configured to be secured to the bottom panel of the board at the front end of the board, the nosecap including a keel extending downwardly from a lower surface of the nosecap, the nosecap being coupled to the board with the contoured front surface positioned to engage the water as the board moves through the water, wherein the nosecap further comprises sloped displacement regions flanking the keel on either side of the keel, wherein the displacement regions are configured to face at least partially forward and to direct water outwardly from the keel as the board is propelled through water, and wherein the nosecap is sufficiently rigid to maintain its shape when the board is uninflated; and wherein the keel comprises:

a longitudinally extending region extending generally parallel to the direction of travel of the board, a substantially vertically extending region, and a rounded transition region between the longitudinally extending region and the substantially vertically extending region.

2. The stand-up paddle board of claim 1, wherein the contoured front surface comprises a displacement surface being forward-facing and laterally outward-facing.

3. The stand-up paddle board of claim 1 wherein the top panel and bottom panel are substantially parallel and wherein the board is generally flat.

4. The stand-up paddle board of claim 1 wherein the top panel and the bottom panel are generally parallel and wherein the board is rockered.

5. The stand-up paddle board of claim 1 wherein the nosecap contacts the bottom panel of the board with the contact surface substantially matching a shape of the board on the bottom of the board.

6. The stand-up paddle board of claim 1 wherein the top panel is substantially uncovered by the nosecap.

7. The stand-up paddle board of claim 1, further comprising:

an inflation valve;

a plurality of D-rings;

a grip pad; and one or more fins on the bottom panel.

8. The stand-up paddle board of claim 2 wherein the nosecap comprises:

a top;

sidewalls;

a bottom; and wherein the top, sidewalls, and bottom form a concave recess shaped to receive a nose of the board, wherein the keel extends from the bottom of the nosecap and wherein the displacement surface is formed by the keel and the bottom of the nosecap.

9. The stand-up paddle board of claim 8 wherein the top and bottom panels of the board, when positioned in the nosecap, are substantially flat.

10. The stand-up paddle board of claim 8 wherein, when a portion of the board is positioned within the nosecap, the keel extends lower than the bottom panel of the board.

11. The stand-up paddle board of claim 8 wherein an interior portion of the top, sidewalls, and bottom all contact the board.

12. The stand-up paddle board of claim 8 wherein the nosecap has rounded regions between the top and the sidewalls, between the sidewalls and the bottom, and between the bottom and the keel.

13. The stand-up paddle board of claim 1 wherein the nosecap is formed by injection-molding.

14. The stand-up paddle board of claim 1 wherein the nosecap is approximately 18-20 inches in length as measured longitudinally relative to the board.

15. The stand-up paddle board of claim 1 wherein the nosecap is removable from the board.

16. The stand-up paddle board of claim 1 wherein a vector normal to the displacement surface has a forward component and a laterally outward component.

17. A nosecap for a stand-up paddle board, the board comprising a drop-stitched inflatable structure and having two ends, the nosecap comprising:

a top portion;

sidewalls coupled to the top portion; and a nosecap bottom portion including a keel extending downwardly and coupled to the sidewalls, and wherein the nosecap further comprises sloped displacement regions flanking the keel on either side of the keel, wherein the displacement regions are configured to face at least partially forward and to direct water outwardly from the keel as the board is propelled through water; wherein the nosecap is non-inflatable and sufficiently rigid to maintain its shape when the board is uninflated, and wherein the nosecap is secured to one end of the board; and wherein the keel comprises:

a longitudinally extending region extending generally parallel to the direction of travel of the board, a substantially vertically extending region, and a rounded transition region between the longitudinally extending region and the substantially vertically extending region.

18. The nosecap of claim 17 wherein the downwardly extending keel of the nosecap has a displacement surface configured to displace water as the board moves through the water, and wherein a vector normal to the displacement surface has a forward component and a laterally outward component.

19. The nosecap of claim 17 wherein the board is substantially flat and wherein the bottom portion of the nosecap is not flat.

20. The nosecap of claim 17 wherein the bottom portion forms a displacement hull.

21. A stand-up paddle board, comprising:

a board comprising a top panel and a bottom panel secured together by drop-stitching, and side panels extending between the top and bottom panels and sealing the drop stitch construction, wherein the board is inflatable;

a semi-rigid, non-inflatable nosecap having a contoured front surface and a contact surface configured to be secured to the bottom panel of the board, the nosecap having a keel extending downwardly from the bottom panel, the nosecap being coupled to the board with the contoured front surface positioned to engage the water as the board moves through the water, wherein the nosecap is sufficiently rigid to maintain its shape when the board is uninflated;

wherein the keel comprises:

a longitudinally extending region extending generally parallel to the direction of travel of the board, a substantially vertically extending region, and a rounded transition region between the longitudinally extending region and the substantially vertically extending region; and wherein the nosecap further comprises sloped displacement regions flanking the keel on either side of the keel, wherein the displacement regions are configured to face at least partially forward and to direct water outwardly from the keel as the board is propelled through water.

* * * * *